US008888517B2

(12) United States Patent
Becavin et al.

(10) Patent No.: US 8,888,517 B2
(45) Date of Patent: Nov. 18, 2014

(54) MULTI-CONTACT CONNECTOR SOCKET FOR RAPID FASTENING TO A PANEL

(71) Applicant: Radiall, Rosny sous Bois (FR)

(72) Inventors: Patrice Becavin, Auzouer en Touraine (FR); Emmanuel Demaret, Tours (FR)

(73) Assignee: Radiall, Rosny sous Bois (FR)

( * ) Notice: Subject to any disclaimer, the term of this patent is extended or adjusted under 35 U.S.C. 154(b) by 45 days.

(21) Appl. No.: 13/858,419

(22) Filed: Apr. 8, 2013

(65) Prior Publication Data

US 2013/0280933 A1 Oct. 24, 2013

(30) Foreign Application Priority Data

Apr. 18, 2012 (FR) ..... 12 53573

(51) Int. Cl.

| | |
|---|---|
| ***H01R 13/62*** | (2006.01) |
| ***H01R 13/629*** | (2006.01) |
| ***H01R 13/74*** | (2006.01) |
| ***H01R 43/26*** | (2006.01) |

(52) U.S. Cl.

CPC ..... *H01R 13/629* (2013.01); *H01R 13/74* (2013.01); *H01R 43/26* (2013.01)

USPC ..... 439/153

(58) Field of Classification Search

CPC ..... H01R 13/635; H01R 13/595

USPC ..... 439/153, 345, 953, 378, 372

See application file for complete search history.

(56) References Cited

U.S. PATENT DOCUMENTS

| | | | | |
|---|---|---|---|---|
| 3,582,867 | A | 6/1971 | Thompson et al. | |
| 4,929,184 | A | 5/1990 | Emadi et al. | |
| 4,934,950 | A | 6/1990 | Green et al. | |
| 8,075,331 | B2 * | 12/2011 | Gazelot et al. | 439/353 |
| 8,231,399 | B2 * | 7/2012 | Daubigney | 439/316 |
| 8,267,711 | B2 * | 9/2012 | Walker et al. | 439/345 |
| 2003/0114044 | A1 | 6/2003 | Nakamura et al. | |
| 2011/0315442 | A1 * | 12/2011 | Nolting et al. | 174/652 |

FOREIGN PATENT DOCUMENTS

| | | | |
|---|---|---|---|
| DE | 197 09 811 | A1 | 9/1998 |
| DE | 103 30 853 | A1 | 2/2005 |
| DE | 20 2010 008 319 | U1 | 1/2012 |
| EP | 1 708 313 | A2 | 10/2006 |
| EP | 2 003 754 | A1 | 12/2008 |
| GB | 961714 | A | 6/1964 |
| JP | A-61-124074 | | 6/1986 |

OTHER PUBLICATIONS

French Search Report and Written Opinion issued in French Patent Application No. 12 53573 on Jan. 17, 2013 (with translation).

French Search Report and Written Opinion issued in French Patent Application No. 12 53575 on Dec. 4, 2012 (with translation).

U.S. Appl. No. 13/865,295, filed Apr. 18, 2013 in the name of Becavin, P.

Jun. 13, 2014 Office Action issued in U.S. Appl. No. 13/865,295.

* cited by examiner

*Primary Examiner* — Phuongchi T Nguyen

(74) *Attorney, Agent, or Firm* — Oliff PLC

(57) ABSTRACT

A connector socket has two hooking parts each having at least one hook to fasten to a housing, at least one hooking part is mounted on the housing; the two hooking parts move apart from each other when at least the slidable hooking part slides from a retracted position towards a deployed position; at least one tongue that is connected to the slidable hooking part to cause the hooking part to slide from a deployed position to a retracted position when an operator presses against the tongue; and at least one spring distinct from the hooking parts, each spring having one end connected to the housing and its other end connected to a corresponding slidable hooking part and exerting a thrust force thereon transversely to the axis of the housing, at least when in a deployed position and in the absence of pressure being applied on the corresponding tongue.

19 Claims, 7 Drawing Sheets

MULTI-CONTACT CONNECTOR SOCKET FOR RAPID FASTENING TO A PANEL

FIELD OF THE INVENTION

The present invention relates to a connector socket, in particular for a multi-contact connector, and that is for fastening to a panel.

The invention also relates to associated installation and removal methods.

BACKGROUND OF THE INVENTION

Numerous means are already known for fastening a multi-contact connector socket to a panel. Of these means, mention may be made of fastener means constituted by two screw-and-nut systems, each of the two screws passing both through an opening formed in a respective lateral end of the housing of the socket and an opening formed in the panel beside a larger opening in which the socket is received.

With certain multi-contact connectors, those screws can be used as polarizing means that make it possible to provide mutual locking between a male connector and a female connector. Although presently-existing means for fastening a multi-contact connector to a panel are effective, in particular when subjected to high levels of mechanical stress, they present certain drawbacks, such as:

- relatively long periods of time are required for installation or removal;
- it is always necessary to use a tool; and
- removal can be performed only from one face of the panel, either only from the front face, i.e. the side where a connection is made, or else only from the rear face, i.e. the side where the contacts extend in the socket.

Also known is a through adapter for an optical fiber connector that is for fastening to a panel, e.g. as sold under the trade name KRONE FiberPLUS®, there being a single fastener part, commonly referred to as a "clip" that is placed around the adapter, that part having two hooks for fastening to the panel and two tongues each of which can receive finger pressure. That adapter can be removed only from one face of the panel. In addition, a drawback with that adapter is that installing the clip and the shape and the dimensions of the hooks do not make it possible, for any given clip, to obtain fastening over a relatively large range of panel thicknesses. Another major drawback is that the force holding the adapter to the panel as applied by the clip is weak, since it is directly associated with the intrinsic flexibility of the clip. Such a weak holding force can be risky if severe mechanical stresses should arise, such as high levels of vibration or a large traction force on the connector.

There exists a need to further improve the fastening of a connector socket, in particular of a multi-contact connector, to a panel, in particular in order to mitigate the above-mentioned drawbacks in full or in part.

OBJECT AND SUMMARY OF THE INVENTION

An object of the invention is to satisfy this need, and, in exemplary embodiments the invention achieves this object with the help of a connector socket for fastening to a panel and comprising a housing configured to be received in part in an opening in a panel, wherein the socket comprises:

- two hooking means, each comprising at least one hook for fastening the housing, at least one hooking means being mounted on the housing to slide transversely to its axis between at least a retracted, release position and at least a deployed, fastening position; the two hooking means moving apart from each other when at least the slidable hooking means slide from the retracted position towards the deployed position;
- at least one tongue against which an operator's finger can bear extending from a lateral side of the housing, each tongue being connected to slidable hooking means in order to cause the hooking means to slide from a deployed position to a retracted position when an operator presses against the tongue; and
- at least one spring distinct from the hooking means, each spring having one end connected to the housing and its other end connected to corresponding slidable hooking means and exerting a thrust force thereon transversely to the axis of the housing, at least when in a deployed position and in the absence of pressure being applied on the corresponding tongue.

By means of the invention, the connector socket can be installed and/or removed on or from a panel in a short length of time, with this being advantageous on an industrial scale, in particular when it is necessary to install and/or remove a large number of sockets on or from a single panel. Typically, an operation of installing or removing a multi-contact connector socket of the invention need occupy only a few seconds.

In addition, it is possible to avoid using a tool since installation and/or removal can be performed by an operator merely by applying finger pressure on each tongue.

In the invention, because the hooking force is the force directly applied by a spring that is separate from a tongue on which pressure is applied, it is possible to obtain a force that is considerable.

In the context of the invention, provision may be made to arrange a plurality of springs to co-operate with the same slidable hooking means in order to increase the hooking force.

Likewise, in the invention, it is possible to define a long sliding stroke for each hooking means between its extreme positions, respectively its deployed, fastening position and its retracted, release position. This sliding stroke is independent of the hooking force, which is associated with the force of the spring connected to the hooking means. A connector socket of the invention can thus be fastened to panels having a wide range of thicknesses. Typically, a multi-contact connector socket of the invention is suitable for fastening to a panel having thickness in the range 0.8 millimeters (mm) to 2.5 mm.

In other words, the invention defines releasable means for fastening a connector socket to a panel and making it possible for installation and/or removal to be both fast and effective, i.e. to provide fastening that is capable of withstanding severe mechanical stresses, such as vibration or traction on the connector.

A connector socket of the invention is entirely suitable for being fastened instead of and in the place of an existing connector socket that is fastened to a panel by fastener means of the prior art. This can be advantageous, in particular for multi-contact connectors.

The hooking means may all be identical with one another, having springs with mutually identical ratings. It is thus possible to provide symmetrical hooking means with it being necessary to provide identical pressure forces on each tongue.

In an advantageous embodiment, the connector socket includes a release tab connected to hooking means and accessible from the face of the housing that is opposite from its face beside which each tongue extends, the release tab being configured to co-operate with a tool, such as a screwdriver, to cause the hooking means to slide from a deployed position to a retracted position. It is thus possible to remove a connector socket of the invention not manually from the face beside which the tongue(s) extend(s), but by using a tool, such as a screwdriver, from the opposite face. This may be advantageous, in particular if access to the panel for an operator's hand is limited. In other words, by means of a release tab, it is possible to use a tool to remove a socket even in an environment involving a panel with limited access.

In variant exemplary embodiments, the tongue(s) may extend(s) beside the rear face of the housing, while the release tab may be accessible to the tool from the front face of the housing.

In first exemplary embodiments, the socket of the invention includes two slidable hooking means, two tongues each connected to a respective one of the two slidable hooking means and extending on either side of the housing, and two springs each connected to a respective one of the slidable hooking means.

In second exemplary embodiments, the socket of the invention includes one slidable hooking means and one hooking means that is stationary relative to the housing and that extends transversely to the axis X of the housing in a fastening position, a single tongue connected to the slidable hooking means and extending from one lateral side of the housing, and a single spring connected to the slidable hooking means.

The inside shape of a hook in section in a plane parallel to the axis of the housing, may advantageously have the shape of a sloping ramp with its end terminated by a flat in order to provide a plane bearing surface for bearing against a panel. A flat at the end of the hook makes it possible to have a plane bearing surface against the panel on which the socket of the invention is fastened, thus making it possible to obtain secure fastening even in the event of the panel and/or the connector socket being subjected to severe mechanical stresses.

Each hooking means preferably has two hooks, one of which is slidable on the top face of the housing and the other of which is slidable on the bottom face of the housing. A socket of the invention with four hooks provides better mechanical retention, in particular when a traction force is exerted on the rear of the socket of the connector.

In advantageous exemplary embodiments, the socket of the invention may include a holder tab connected to hooking means, and the housing may include an abutment for co-operating with the holder tab in order to hold the hooking means in its deployed extreme position. Because of the co-operation between the holder tab and the abutment formed on the housing, retention of the hooking means as urged by the springs when the socket is not connected to a panel is achieved in a manner that is simple.

In an advantageous variant, the abutment is a portion in relief of elongate shape arranged on the top face or the bottom face of the housing, the portion in relief co-operating with at least one rib provided on the same face of the housing to define a slideway within which the holder tab slides when the hooking means slide from a retracted position to a deployed position.

Each spring may be pre-stressed in the deployed extreme position. This enables the spring to be compressed to a greater or lesser extent in this position so as to modify its hardness as a function of the pressure force on the corresponding tongue.

Preferably, a hooking means and a tongue, together with a holder tab, if any, and a release tab, if any, are made as a single part referred to as a hooking part. This makes the socket simpler to fabricate and reduces the number of steps required for assembling a socket in accordance with the invention.

Also preferably, a hooking part is made from cut and folded sheet metal.

Each spring is a helical compression spring freely mounted in a recess formed in the housing with one end in abutment against the end of the housing and its other end in abutment against a portion connected to the tongue and to the hooking means.

In advantageous exemplary embodiments, each spring is in abutment against a hooking part. This provides easy installation without requiring additional parts specifically for installing a spring.

A connector socket of the invention may include an attachment portion extending the housing from the rear face of the housing opposite from its front face. By way of example, the attachment portion may be clipped directly on the housing. By way of example, the attachment portion is configured to receive cables having the contacts of a multi-contact connector mounted thereon. In a plane perpendicular to the axis of the cells, the attachment portion may include an attachment zone having a surface for receiving the cables, which surface is semicircular in shape. A plurality of attachment zones may be arranged side by side across the width of the housing.

At each of its lateral ends, the housing may include a plane surface for bearing against a panel.

In an advantageous variant, provision may be made for a guide peg configured to co-operate with an opening in a panel, and projecting from one of the bearing surfaces, while polarizing means configured to co-operate with polarizing means of a plug complementary to the socket project from the other bearing surface, the polarizing means of the socket being male and the polarizing means of the complementary plug being female, or vice versa.

In other exemplary embodiments, the invention also provides a multi-contact connector comprising a socket as described above in which its housing has cells, each for receiving one contact.

The housing may be made as a single part, thereby making its fabrication simple and reducing the number of steps required for assembling a multi-contact connector with a socket in accordance with the invention. There is then no need to have recourse to an insert including the cells, with it then being necessary to insert such an insert into the housing.

The housing may have five to one hundred cells formed therein. These cells may all be identical, and each of them may present a cross-section that is circular in shape.

Other exemplary embodiments of the invention also provide a connection assembly comprising:

- a multi-contact connector as specified above; and
- a multi-contact connector comprising a plug of complementary type, the connectors being configured to be locked together.

The contacts of the connectors may optionally all be of the same type. The contacts may comprise contacts conveying an optical signal and/or contacts conveying an electrical signal, and/or contacts conveying power.

In other exemplary embodiments, the invention provides a method of installing a connector socket as described above in a panel, in which method the following steps are performed:

- applying finger pressure on each tongue;
- inserting the housing in part in an opening in the panel while maintaining pressure on each tongue; and
- once the housing is received in part in the opening in the panel, releasing pressure on each of the tongues.

In other exemplary embodiments, the invention also provides a method of removing a connector socket as described above from a panel, in which method the following steps are performed:

applying finger pressure on each tongue;

removing the housing from the opening in the panel while maintaining pressure on each tongue; and once the housing has been removed from the opening in the panel, releasing pressure on each tongue.

Alternatively, removal may consist in performing the following steps:

inserting a tool in the opening in the panel in order to co-operate at least with a release tab;

turning the tool about its axis or using the tool as a lever against the housing in order to retract the hooking means to which the release tab is connected; and removing the housing and the tool from the opening in the panel.

BRIEF DESCRIPTION OF THE DRAWINGS

The invention can be better understood on reading the following detailed description of non-limiting embodiments thereof and on examining the accompanying figures, in which.

MORE DETAILED DESCRIPTION

Figure 1:
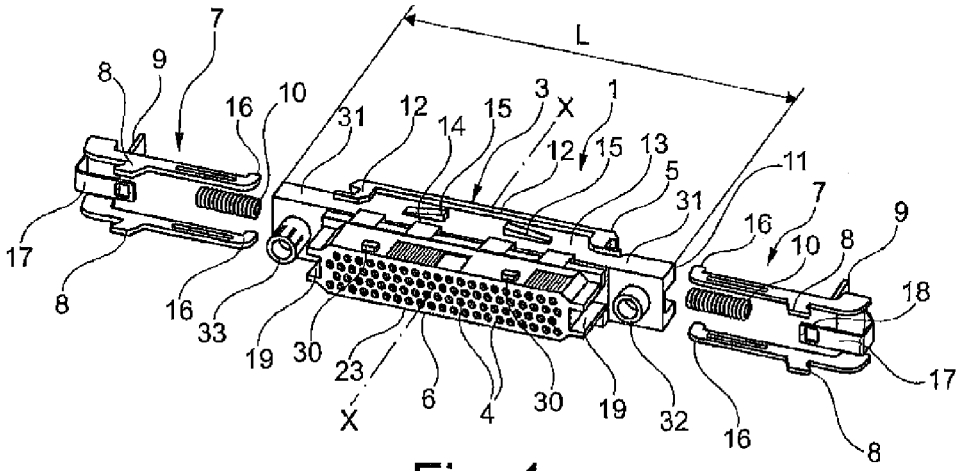
FIG. 1 is an exploded view of a multi-contact connector socket in a first embodiment of the invention.

Throughout the present application, the terms "front", "rear", "top", and "bottom" should be considered with reference to the connector socket 1 of the invention in its configuration fastened to a panel 2. Thus, the front face 10 of the connector socket 1, that can also be called its connection face, is the face via which a connection is made with a complementary connector plug. Likewise, the front face 20 of the panel 2 is the face beside which the connection is made. The top face 13 of the socket 1 is the face that is situated on top.

FIG. 1 shows a multi-contact connector socket 1 of the invention, which socket is of the male type.

In the examples described below, the multi-contact connector socket 1 of the invention is for fastening to a panel 2, the panel 2 possibly being a panel of a housing for electronic equipment, e.g. equipment on board an aircraft. The panel may also be a disconnector panel.

The multi-contact connector including the socket 1 of the invention as described below conveys optical signals, electrical signals, or power. In a variant signals or power of differing types may be conveyed by the multi-contact connector and contacts of differing sizes and types are then arranged simultaneously in the socket 1 of the invention.

The contacts may be single contacts or multiple contacts such as coaxial or tri-axial contacts, quadrax contacts, RJ45 connectors, or any type of high data rate contact. The contacts may also be optical contacts having "expanded beam" type contacts with lenses or "physical contact" contacts of the ARINC 801 or EN 4531 type, or indeed optoelectronic contacts.

FIGS. 1 to 7A show only a socket 1 of a multi-contact connector. The multi-contact connector forms part of an assembly for connection to another multi-contact connector (not shown) including a plug of complementary type, the two multi-contact connectors of the connection assembly advantageously being configured to be locked together. The socket 1 may be of the male type and the plug (not shown) may be of the female type, and vice versa.

The connector socket 1 of the invention firstly comprises a housing 3 that, in the example described, is made as a single piece of plastics material.

The housing includes a plurality of cells 4 formed in the housing 3, extending from a rear face 5 to a front face 6, which may also be referred to as a connection face.

In the example described, the faces 5 and 6 are parallel and they extend perpendicularly to the rectilinear axis X of the cells 4, this rectilinear axis X constituting the axis of the housing.

As shown in FIG. 1, the socket 1 of the multi-contact connector includes two hooking parts 7 each having at least one hook 8 for fastening the housing, each of the hooks being slidably mounted on the housing 3 to slide perpendicularly to its axis X between at least a retracted, release position and at least a deployed, fastening position.

The two hooking parts 7 move away from each other when each of them is sliding from its retracted position (FIG. 4A, FIG. 5) towards its deployed position (FIGS. 2, 2A, 4B, 6).

Each hooking part 7 has a tongue 9, each of which tongues serves as a bearing surface for an operator to apply finger pressure (FIG. 5) and extends parallel to the axis X beside the rear face 5 of the housing 3 and the rear face 21 of the panel 2.

Figure 2:
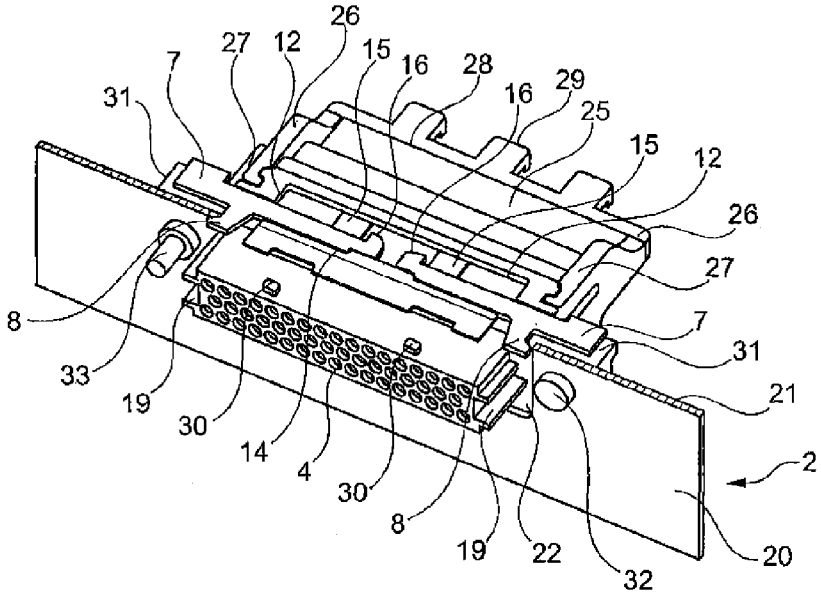
FIG. 2 is a perspective view of a FIG. 1 socket in its configuration when fastened on a panel, the panel being shown in section transversely to the axis of the housing of the socket through the opening in which part of the socket is received.
Figure 2A:
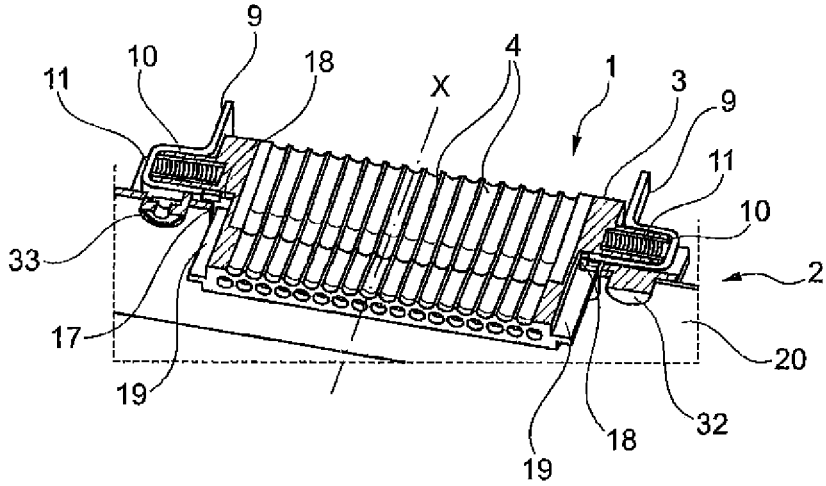
FIG. 2A is a cross-section view of the housing of the socket fastened to the panel as shown in FIG. 2.
Figure 2B:
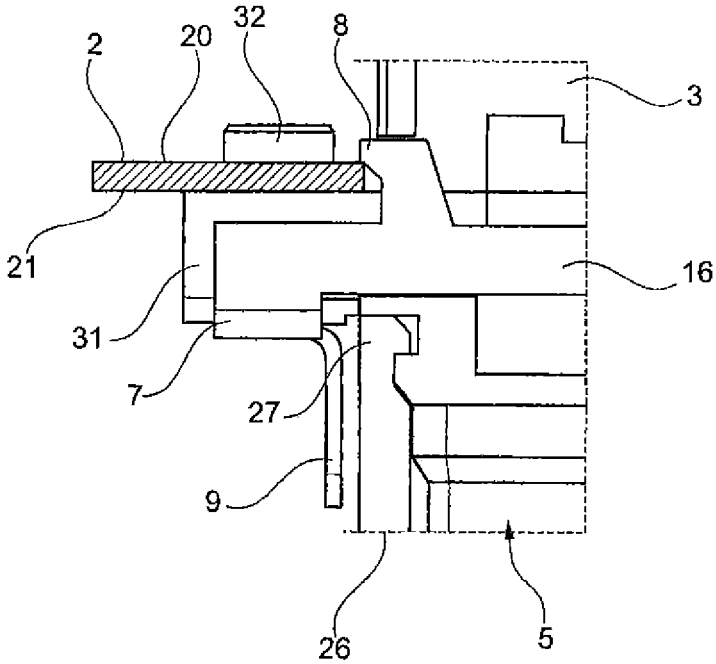
FIG. 2B is a detail view from above of the socket fastened to the panel as shown in FIG. 2.

Two springs 10, which are distinct from the hooking parts 7, are mounted free in respective recesses 11 in the housing 3, each bearing both against the housing and against a corresponding hooking part 7 (FIG. 2A). Each spring 10 exerts a thrust force on the housing 3 perpendicularly to the axis X of the housing, at least in a deployed position and in the absence of pressure being applied on a corresponding tongue 9. As shown in FIGS. 1 and 2A, each spring 10 is a helical compression spring. Each spring 10 may be mounted in such a manner as to be pre-stressed in the deployed extreme position for fastening the hooking part 7 against which it bears.

As shown better in FIGS. 1 and 2, the housing 3 may have a first rib 12 that extends perpendicularly to the axis X over all or part of the top face 13 of the housing. A second rib 14 is provided on the top face 13 of the housing and extends parallel to the central portion of the first rib 12. Finally, the housing 3 has two elongate portions in relief 15 each in the form of a slope that extends in line with the end portions of the first rib 12. The central portion of the first rib 12 in the example shown is arranged on the top face 13 of the housing and defines the edge of the rear face 5 of the housing. The end portions of the first rib 12 define an edge at the side ends of the housing.

As better shown in FIGS. 1 and 2, each hooking part 7 may have a holder tab 16 that is curved at its end in order to come into abutment against one of the elongate portions in relief 15 when in the deployed extreme position for fastening the part 7.

Figure 4A:
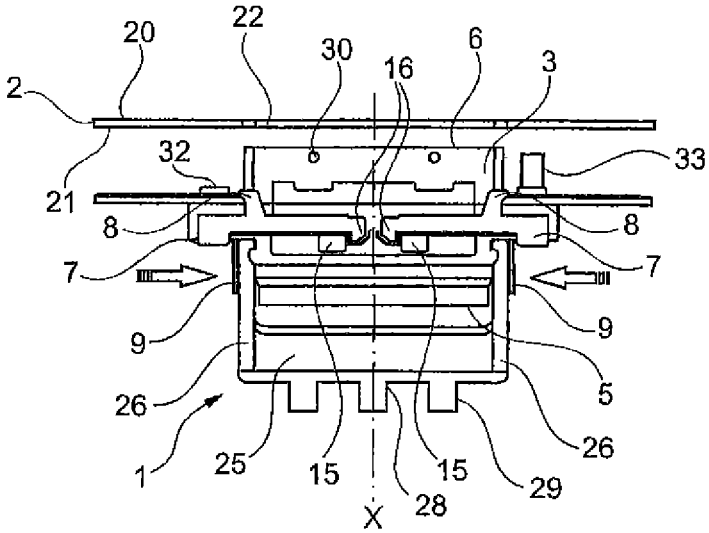
FIGS. 4A and 4B are views from above showing two steps in fastening a connector socket of the invention to a panel via its rear face.
Figure 4B:
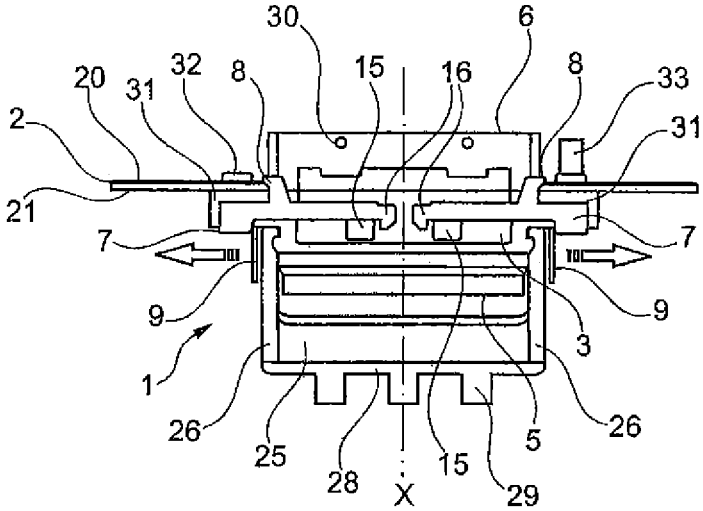
Figure 5:
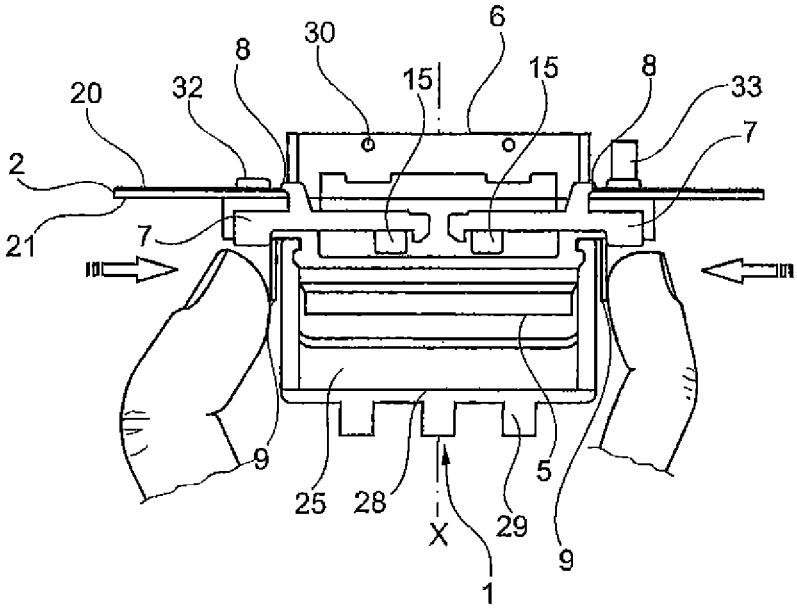
FIG. 5 is a view from above, analogous to FIG. 4A, showing a step of fastening a connector socket of the invention to a panel, with FIG. 5 showing an operator applying finger pressure for this fastening step.
Figure 6:
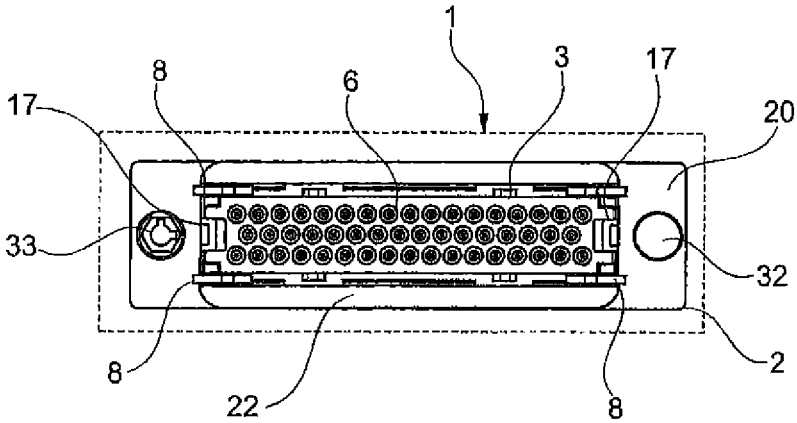
FIG. 6 is a view of the front face of a connector socket of the invention in its configuration fastened to a panel.

As can be seen in FIGS. 2, 4B, and 5, the dimensions of the opening 22 and the thickness of the panel 2 in which a socket 1 of the invention is fastened may be such that in the fastened configuration, the curved end of the holder tab 16 is not in abutment against a portion in relief 15. Specifically, in a fastened configuration as shown in FIGS. 2, 4B, and 5, the hooking part 7 is in an intermediate deployed position, or in other words it is not deployed to its maximum stroke.

The first and second ribs 12 and 14 and the portions in relief 15 act together to define a slideway for sliding the hooking parts 7 perpendicularly to the axis X of the housing 3.

Figure 7:
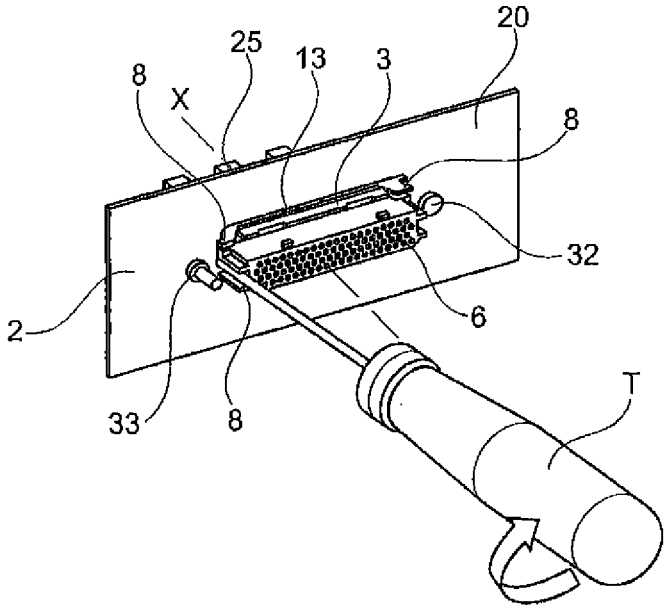
FIG. 7 is a perspective view showing a step of removing a connector socket of the invention when in its configuration fastened to a panel, this step being performed with the help of a tool from the front face of the panel.
Figure 7A:
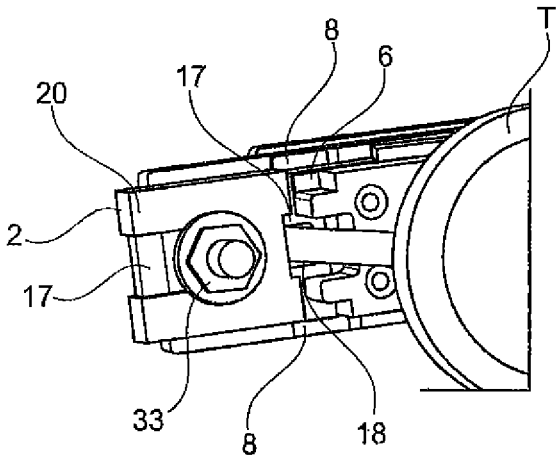
FIG. 7A is a view showing a detail of FIG. 7.

As shown better in FIGS. 1, 2A, 6, and 7A, each hooking part 7 may include a release tab 17 that is accessible to a tool, such as a screwdriver T, from the front face 6 of the housing 3, or in other words from the front face 20 of the panel 2 when the socket is in the fastened configuration. The release tab 17 is configured to co-operate with the tool T to cause the hooking part 7 to slide from a deployed position to a retracted position, as explained below. For example, the release tab 17 may include a notch or an opening 18 of dimensions suitable for receiving the end of a standard screwdriver T. More precisely, at each of its lateral ends, the housing 3 may include a slot 19 formed from the front face 6 of the housing and extending parallel to its axis X. As shown in FIGS. 7, 7A, a standard screwdriver T can be inserted via the front faces 6 and 20 respectively of the housing 3 and of the panel 2 into the slot 19 and can be received in the opening 18 in the fastener tab 17 while the socket 1 is in its configuration fastened to the panel 2.

In order to make a socket 1 of the invention, i.e. in order to assemble mechanically together the housing 3, the hooking parts 7 for fastening the housing 3, and the springs 10, it is possible to proceed as follows.

Firstly, each spring 10 is put into the recess 11 that is provided for this purpose in the housing 3. Thereafter, a hooking part 7 is mounted on each of the two lateral ends of the housing 3 by causing it to slide perpendicularly to the axis X of the housing 3. During this sliding, the holder tab 16 moves in translation in the slideway defined by the ribs 12, 14 and by the portion in relief 15, and at the end of its stroke it is raised by the portion in relief. This sliding is continued until the raised end of the holder tab 16 has gone fully past the portion in relief 15: in this assembly position, which constitutes the deployed extreme position for fastening, the holder tab 16 comes into abutment against the portion in relief 15.

As shown better in FIG. 2A, when the socket 1 includes a release tab 17, 18, a passage is provided in the lateral end of the housing 3 for receiving said release tab and enabling it to be inserted in the passage while the part 7 is being assembled on the housing 3.

Thus, the hooking part 7 is snap-fastened to the housing 3 and can slide from this deployed extreme position for fastening to a retracted extreme position for release. This extreme position for release may be reached by bringing the tongues 9 into abutment against portions 26 connected to the housing 3 (FIG. 4A). It may also be reached by the tongues 9 coming into abutment against the housing 3. It may also be reached by the two facing holder tabs 16 coming mutually into abutment, i.e. by sliding on the same face 13 of the housing along a common axis perpendicular to the axis X.

When the connector socket 1 of the invention is not in its configuration fastened to a panel 2, and in the absence of thrust on the tongues 9, the hooking parts 7 are in the deployed extreme position and they are held by the portions in relief 15 co-operating with the holder tabs 16. In this deployed extreme position, the springs 10 are preferably in the prestressed state.

When a connector socket 1 of the invention is in its configuration fastened to a panel 2, and in the absence of any thrust being applied to the tongues 9, the hooking parts 7 are in a deployed intermediate position and they are not retained by the portions in relief 15, but are rather retained by the hooks 8 acting against the opening 22 in the panel 2 and co-operating with the face 20 of the panel 2.

As shown better in FIG. 1, a hooking part 7 may advantageously have two hooks 8, one sliding on the top face 13 of the housing and the other sliding on the bottom face 23 of the housing. This enables the socket 1 to be fastened using four hooks 8 for fastening the housing. This provides better mechanical retention, in particular in the event of severe traction being applied to the socket 1 towards the rear of the panel 2, or severe traction being applied in a direction perpendicular to the axis X.

Figure 3:
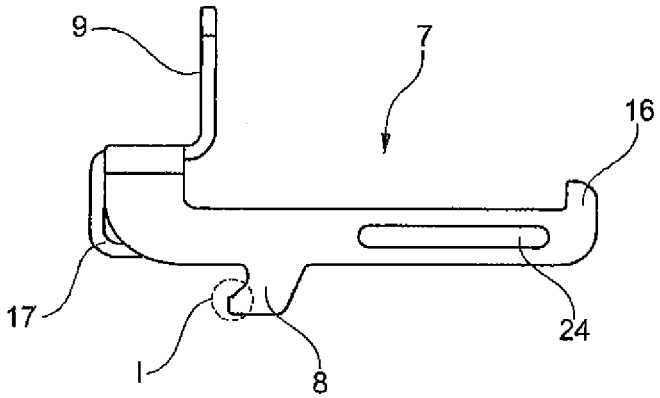
FIG. 3 is a view from above of an embodiment of a hooking part of a connector socket of the invention.
Figure 3A:
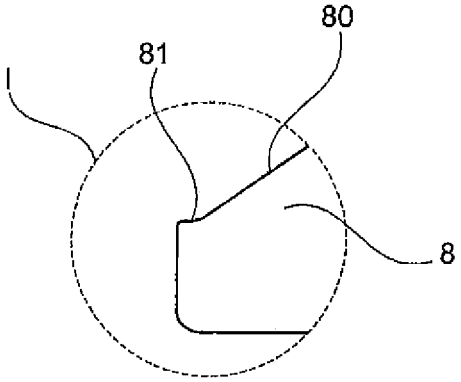
FIG. 3A is a detail view of the hooking part of FIG. 3.

As shown better in FIG. 3A, the inside shape of a hook 8 may, in section in a panel parallel to the axis X of the housing, be in the form of a sloping ramp 80 having its end terminating in a flat 81 in order to provide a plane bearing surface against a panel 2. Such a flat 81 also serves to guarantee retention against the panel 2 in the fastened configuration, even in the event of severe mechanical stresses being applied, such as high levels of vibration and/or traction being applied to the rear of the socket 1 of the connector.

A hooking part 7 may be made of metal, preferably from cut and folded sheet metal. In order to lighten the part 7, it is possible to provide openings in its material, as shown better in FIG. 3.

As can be seen better in FIGS. 2, 4A, 4B, and 5, the connector socket 1 of the invention may include an attachment portion 25 extending the housing 3 along the axis X from the rear face 5. By way of example, the attachment portion 25 has two branches 26, each having one end 27 that is releasably hooked on the housing 3 and another end that is connected to a junction portion 28. The junction portion 28 defines a plurality of attachment zones 29. In the example described, three attachment zones are associated with the housing 3, but the invention is not limited to any particular number of attachment zones 29 or to any particular arrangement of these zones 29 relative to one another.

Although not shown, each attachment zone may present a semicircular reception surface against which the cables to which the connector socket 1 is connected can bear and/or be fastened. The connector socket 1 may include a front gasket for placing on the connection face of the housing 3, and the front gasket may include holes that come into register with the cells 4 when the gasket is in place on the connection face 6. By way of example, the front gasket may be made of silicone.

Although likewise not shown, a connector socket 1 may include a rear gasket for placing against the rear face 5 of the housing. In a manner similar to the front gasket, the rear gasket may include as many holes as the housing 3 has cells 4, with the holes in the rear gasket coming into register with the cells 4 when the rear gasket is in place on the rear face 5 of the housing.

As shown in the various figures, one or more locking pegs 30 may be provided on at least the top face 13 of the housing. Other locking pegs may also be provided on the bottom face of the housing 3. In the examples under consideration, these locking pegs 30 are made integrally with the housing 3. These locking pegs 30 are configured to co-operate with a locking cap (not shown) for achieving mutual locking with a plug that is complementary to the socket 1. For more details concerning the co-operation between the locking pegs and a locking cap, reference may be made to application EP 1 708 313, for example.

On each of its lateral ends, the connector socket 1 may include a projection 31 providing a plane bearing surface against the rear face 21 of the panel 2. A guide peg 32 configured to co-operate with a opening in a panel 2 may project from one of the bearing surfaces 31. Male polarizing means 33 configured to configuration with female polarizing means of a plug complementary to the socket 1 may project from the other bearing surface 31.

In the examples shown, it is specified at this point that the guide peg 32 and the male polarizing means 33 do not act as fastener means of the socket 1, but, where appropriate, it is also possible to make use of one and/or the other of the peg 32 and polarizing means 33 in order to provide complementary fastening of the screw-and-nut type.

As can be seen in FIG. 2, the maximum bulk resulting from the connection assembly 1 in the example described is determined by the distance L between the two projections 31.

In an embodiment of a connector socket 1 of the invention, the distance L between the two projections 31, as measured perpendicularly to the axis X, is 80 mm, the height of the housing 3 is 14 mm, the length of the housing 3 measured along the axis X between two opposite faces 13 and 23 is 23.50 mm.

Naturally, the values given above for those distances are given purely by way of indication, and in other examples the values could be smaller than those given above.

With reference to FIGS. 4A to 5, there follows a description of the steps involved in fastening the connector socket 1 to the panel 2 from its rear face 21.

The housing 3 is initially positioned facing the opening 22 in the panel 2, and simultaneously finger pressure is applied against the two tongues 9 so as to move the two hooking parts 7 towards the other, as represented by two arrows pointing towards each other in FIGS. 4A and 5.

The housing 3 is inserted in part into the opening 22 in the panel 2 while still pressing the two tongues 9 towards each other. Where appropriate, the guide pegs 32 and the polarizing means 33 provide guidance with each of them co-operating with a lateral opening in the opening 22 of the panel.

Once the housing 3 is housed in part in the opening 22 in the panel 2, with its projections 31, if any, bearing against the rear face 21 of the panel 2, pressure is released from the two tongues 9, as represented by two arrows pointing away from each other in FIG. 4B.

The fastener hooks 8 then bear against the opening 22 in a deployed position for fastening, this position being determined as a function of the thickness of the panel 2 and of the dimensions of the opening 22.

In order to separate a connector socket 1 from a panel 2 to which it is fastened, it is possible to proceed in two alternative ways.

In the first way, the removal is performed manually from the rear of the connector, i.e. from the rear face 21 of the panel 2. The above-described steps are performed except that the housing 3 is taken out from the opening 22 in the panel 2.

Specifically, the following steps are performed:

finger pressure is applied to urge the two tongues 9 towards each other (FIG. 5);

the housing 3 is taken out of the opening 22 in the panel while continuing to press on the two tongues 9; and once the housing has been removed from the opening in the panel, the two tongues 9 are released.

Alternatively, this assembly is performed using a standard tool such as a screwdriver T from the front of the connector, i.e. the front face 20 of the panel 2. The removal step in this alternative are described with reference to FIGS. 7 and 7A.

Initially, the tool T is inserted in the opening in the panel so as to co-operate with at least one release tab 17. More precisely, the end of the tool is inserted in the slot 19 in the housing 3 until it penetrates into the opening 18 in the release tab 17.

The tool is then turned about its axis, as represented by the arrow in FIG. 7. This turning serves to slide causes the two hooks 8 of the part 7 that includes the release tab 17 away from the deployed position for fastening a retracted position for release in which the hooks 8 are disengaged from the opening 22. Instead of turning the tool T, it is possible to press the tool T against the housing 3 in order to provide a lever effect for disengaging the hooks 8.

The housing 3 and the tool T are then removed from the opening 22 in the panel 2. In order to remove the housing 3, it is possible to insert the tool T and apply a turning or lever force thereon using only one of the release tabs, or using each of the release tabs in succession. When using each of them, the housing 3 is removed from the opening 22 once both of the release tabs have been retracted.

Figure 8:
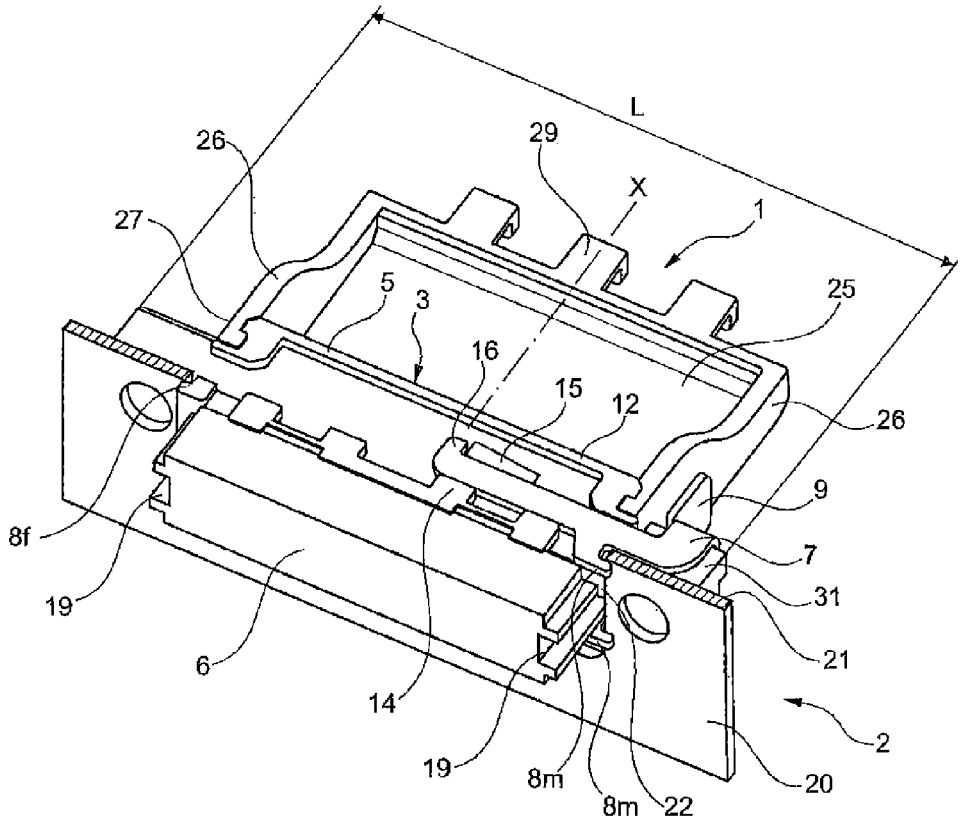
FIG. 8 is a perspective view of a multi-contact connector socket in a second embodiment of the invention, the socket being in its configuration fastened to a panel, the panel being shown in section transversely to the axis of the housing of the socket through the opening in which part of the socket is received.

FIG. 8 shows a second embodiment of a multi-contact connector socket 1 of the invention. It is specified at this point has the figure does not show various portions of the housing 3 that are nevertheless present, such as the cells housing contacts, the pegs for locking to a locking cap, . . . . All the other elements that are in common and that are shown are given the same numerical references.

In this second embodiment, the connector socket 1 has a hooking part 7 including sliding hooking means 8*m* and stationary hooking means 8*f* that are stationary relative to the housing 3 and that extend transversely to the axis X of the housing 3 in a fastening position. The stationary hooking means 8*f* may comprise a single hook 8*f* over the full height of the housing 3 or a plurality of hooks, typically two hooks, that are distributed up the height. The stationary hooking means 8*f* may be made of the same material as the housing 3, i.e. they may be made integrally with the housing 3 while it is being molded. In this embodiment, only one tongue 9 is provided that is connected to the sliding hooking means 8*m* as descried above for the first embodiment and extending from one lateral side of the housing, and it is associated with only one spring (not shown) that is connected thereto.

The steps of fastening the connector socket 1 in the second embodiment are performed as for the first embodiment, except that an operator applies finger pressure against only one tongue 9 and inserts the stationary hooking means 8*f* through the opening 22 in the panel 2, and then positions the hooking means so as to bear against the opening, after which pressure on the tongue 9 is released so as to cause the two sliding fastener hooks 8*m* to bear against the opening 22 of the panel 2.

For manual removal, the procedure is likewise as for the first embodiment, i.e. pressure is applied to the single tongue 9 to cause the sliding hooking means 8*m* to slide from the deployed position for fastening towards a retracted position for release. In contrast, the housing 3 is necessarily separated from the opening in the panel 2 from the side of the sliding hooking means 8*m* once they are in their retracted position for release and then, once the sliding means 8*m* are disengaged from the opening 22 and present beside the rear face 21 of the panel, it is possible for the stationary hooking means 8*f* to be disengaged from the opening in the panel 2.

For removal using a tool T, the procedure is likewise as in the first embodiment, except that the tool is inserted on one side only until the sole sliding hooking means 8*m* have disengaged the opening 22 in the panel 2, after which the stationary hooking means 8*f* are disengaged.

The invention is not limited to the above-described examples; in particular, the characteristics of the examples shown may be combined in variants that are not shown.

The term "comprising a" should be understood as meaning "comprising at least one", unless specified to the contrary.

What is claimed is:

1. A connector socket for a multi-contact connector, the socket being for fastening to a panel and comprising a housing configured to be received in part in an opening in the panel, the socket further comprising:

two hooking devices, each of the hooking devices comprising at least one hook configured to fasten the housing to the panel, at least one of the two hooking devices being mounted on the housing to slide transversely to the insertion axis of the housing between at least a retracted, release position and at least a deployed, fastening position, the two hooking devices moving apart from each other when the at least one slidable hooking device slides from the retracted position towards the deployed position;

at least one tongue against which an operator's finger can bear and that extends from a lateral side of the housing, the at least one tongue being connected to the at least one slidable hooking device to cause the at least one slidable hooking device to slide from the deployed position to the retracted position when the operator presses against the at least one tongue; and at least one helical spring distinct from the two hooking devices, the at least one helical spring having one end connected to the housing and an other end connected to the at least one slidable hooking device and exerting a thrust force thereon transversely to the axis of the housing, at least when in a deployed position and in the absence of pressure being applied on the at least one tongue.

2. The connector socket according to claim 1, comprising (i) two of the slidable hooking devices, (ii) two of the tongues each connected to a respective one of the two slidable hooking devices and extending on either side of the housing, and (iii) two of the helical springs each connected to a respective one of the two slidable hooking devices.

3. The connector socket according to claim 1, comprising:

one of the slidable hooking devices; and one of the tongues connected to the one slidable hooking device and extending from one lateral side of the housing; and one of the helical springs connected to the one slidable hooking device;

wherein one of the two hooking devices is stationary relative to the housing and extends transversely to the axis of the housing in a fastening position.

4. The connector socket according to claim 1, wherein the inside shape of the at least one hook, in section in a plane parallel to the axis of the housing, is a sloping ramp with an end terminated by a flat in order to provide a plane bearing surface configured to bear against the panel.

5. The connector socket according to claim 1, wherein each of the two hooking devices has two of the hooks, one of which is slidable on a top face of the housing and the other of which is slidable on a bottom face of the housing.

6. The connector socket according to claim 1, wherein the at least one helical spring is pre-stressed in the deployed position.

7. The connector socket according to claim 1, wherein one of the two hooking devices and the at least one tongue, together with a holder tab, if any, and a release tab, if any, are made as a single part referred to as a hooking part.

8. The connector socket according to claim 1, further comprising an attachment portion extending the housing from a rear face of the housing opposite from a front face of the housing.

9. A method of installing the connector socket according to claim 1 in a panel, the method comprising the following steps:

applying finger pressure on the at least one tongue;

inserting the housing in part in an opening in the panel while maintaining pressure on the at least one tongue; and once the housing is received in part in the opening in the panel, releasing pressure on the at least one tongue.

10. A method of removing the connector socket according to claim 1 that is fastened to a panel, the method comprising the following steps:

applying finger pressure on the at least one tongue;

removing the housing from an opening in the panel while maintaining pressure on the at least one tongue; and once the housing has been removed from the opening in the panel, releasing pressure on the at least one tongue.

11. The connector socket according to claim 1, further comprising:

a holder tab connected to the at least one slidable hooking device; and an abutment configured to co-operate with the holder tab to hold the at least one slidable hooking device in the deployed position.

12. The connector socket according to claim 11, wherein the abutment is a portion in relief of elongate shape arranged on the top face or the bottom face of the housing, the portion in relief co-operating with at least one rib provided on the same face of the housing to define a slideway within which the holder tab slides when the at least one slidable hooking device slides from the retracted position to the deployed position.

13. The connector socket according to claim 1, wherein the at least one helical spring is a compression spring freely mounted in a recess formed in the housing with one end in abutment against an end of the housing and an other end in abutment against a portion connected to the at least one tongue and to the at least one slidable hooking device.

14. The connector socket according to claim 12, wherein the at least one helical spring is in abutment against a hooking part.

15. The connector socket according to claim 1, wherein, at each lateral end of the housing, the housing comprises a plane surface configured to bear against the panel.

16. The connector socket according to claim 15, wherein a guide peg configured to co-operate with an opening in the panel projects from one of the bearing surfaces, and wherein a polarizing device configured to co-operate with a polarizing device of a plug complementary to the socket projects from the other bearing surface, the polarizing device of the socket being male and the polarizing device of the complementary plug being female, or vice versa.

17. The connector socket according to claim 1, further comprising a release tab connected to the at least one slidable hooking device and accessible to a tool, from a face of the housing that is opposite from a face of the housing beside which the at least one tongue extends, the release tab being configured to co-operate with the tool to cause the at least one slidable hooking device to slide from the deployed position to the retracted position.

18. The connector socket according to claim 17, wherein at least one tongue extends beside a rear face of the housing, while the release tab is accessible to the tool from a front face of the housing.

19. A method of removing the connector socket according to claim 17 that is fastened to a panel, the method comprising the following steps:

inserting a tool in an opening in the panel in order to co-operate at least with the release tab;

turning the tool about an axis of the tool or using the tool as a lever against the housing in order to retract the at least one slidable hooking device to which the release tab is connected; and removing the housing and the tool from the opening in the panel.

* * * * *